US010156214B2

(12) United States Patent
Kanzaki

(10) Patent No.: US 10,156,214 B2
(45) Date of Patent: Dec. 18, 2018

(54) INTAKE MANIFOLD

(71) Applicant: TOYOTA JIDOSHA KABUSHIKI KAISHA, Toyota-shi, Aichi-ken (JP)

(72) Inventor: Yasunori Kanzaki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/637,463

(22) Filed: Jun. 29, 2017

(65) Prior Publication Data

US 2018/0010557 A1 Jan. 11, 2018

(30) Foreign Application Priority Data

Jul. 7, 2016 (JP) ..... 2016-135076

(51) Int. Cl.
*F02M 35/10* (2006.01)
*F02M 26/09* (2016.01)
(Continued)

(52) U.S. Cl.
CPC ..... *F02M 35/10222* (2013.01); *F02M 26/09* (2016.02); *F02M 26/17* (2016.02);
(Continued)

(58) Field of Classification Search
CPC .. F02M 35/10222; F02M 26/19; F02M 26/06; F02M 26/05; F02M 26/50;
(Continued)

(56) References Cited

U.S. PATENT DOCUMENTS 5,456,204 A * 10/1995 Dimitrov ..... C30B 7/00 117/71
7,077,190 B2 * 7/2006 Hayashi ..... F01N 5/02 165/148
(Continued)

FOREIGN PATENT DOCUMENTS

JP H07-063131 A 3/1995
JP 2010-096065 A 4/2010
(Continued)

OTHER PUBLICATIONS

180511 Ito et al JP 2016 089687 Machine Translation.*

*Primary Examiner* — David Hamaoui
*Assistant Examiner* — Carl Staubach
(74) *Attorney, Agent, or Firm* — Oliff PLC

(57) ABSTRACT

An intake manifold provided in an internal combustion engine to be mounted in a vehicle includes: a plurality of intake-air branch pipes; an EGR chamber configured such that EGR gas is introduced into the EGR chamber; and a plurality of EGR ports communicating the plurality of intake-air branch pipes with the EGR chamber. A chamber bottom face is provided with a plurality of recessed zones so as to correspond to the plurality of EGR ports, each of the plurality of recessed zones is provided near an opening of its corresponding EGR port on an EGR-chamber side, and all planes constituting the each of the plurality of recessed zones is configured to be inclined so as to be placed on a mounting lower side toward a position closer to the opening, as compared with a position away from the opening.

8 Claims, 7 Drawing Sheets

(51) Int. Cl.

| | |
|---|---|
| ***F02M 26/17*** | (2016.01) |
| ***F02M 35/108*** | (2006.01) |
| ***F02M 35/116*** | (2006.01) |
| ***F02M 26/44*** | (2016.01) |
| *F02M 26/02* | (2016.01) |

(52) U.S. Cl.
CPC ..... *F02M 26/44* (2016.02); *F02M 35/1085* (2013.01); *F02M 35/116* (2013.01); *F02M 26/02* (2016.02)

(58) Field of Classification Search
CPC ..... F02M 26/09; F02M 26/02; F02M 26/23; F02D 41/0065; F02B 29/0406
See application file for complete search history.

(56) References Cited

U.S. PATENT DOCUMENTS 7,389,071 B2 * 6/2008 Katsuyama ..... G03G 15/0881 399/258
8,967,127 B2 * 3/2015 Enami ..... F02M 35/10222 123/568.11
9,926,895 B2 * 3/2018 Sudo ..... F02M 35/104
2005/0039730 A1 * 2/2005 Nishida ..... F02M 35/10085 123/568.17
2006/0191505 A1 * 8/2006 Doko ..... F02M 35/10039 123/184.59
2009/0173306 A1 * 7/2009 Matsudaira ..... F02M 26/17 123/184.53
2009/0223476 A1 * 9/2009 Shinkai ..... F02M 26/12 123/184.21
2016/0123283 A1 * 5/2016 Newman ..... F02M 35/10222 123/572
2017/0226968 A1 * 8/2017 Nakamura ..... F02M 26/20

FOREIGN PATENT DOCUMENTS

JP 2012-112297 A 6/2012
JP 2016089687 A * 5/2016 ..... F02M 25/07

* cited by examiner

INTAKE MANIFOLD

INCORPORATION BY REFERENCE

The disclosure of Japanese Patent Application No. 2016-135076 filed on Jul. 7, 2016 including the specification, drawings and abstract is incorporated herein by reference in its entirety.

BACKGROUND

1. Technical Field

The disclosure relates to an intake manifold placed in an internal combustion engine to be provided in a vehicle.

2. Description of Related Art

In terms of a multi-cylinder internal combustion engine, generally, air is introduced into combustion chambers of respective cylinders provided in a cylinder head via an intake manifold including a plurality of intake-air branch pipes connected to intake ports of the respective cylinders. Japanese Patent Application Publication No. 2010-096065 (JP 2010-096065 A) describes an intake manifold provided integrally with an EGR chamber into which Exhaust Gas Recirculation (EGR) gas recirculated from an exhaust passage is introduced. In such an intake manifold, the EGR chamber communicates with the intake-air branch pipes via respective EGR ports, and the EGR gas introduced into the EGR chamber is distributed between the intake-air branch pipes via the EGR ports.

SUMMARY

In the meantime, when the EGR gas is cooled to a temperature of a condensation point of water or lower, water vapor in the EGR gas condenses so that condensed water is generated. When such condensed water remains in the EGR chamber for a long time, HC and soot in the EGR gas are dissolved in the condensed water and accumulated, thereby resulting in that they remain in the EGR chamber as deposits after evaporation of the condensed water. The deposits may enter the EGR port by a flow of the EGR gas and clog the EGR port.

In the meantime, in the intake manifold provided integrally with the EGR chamber as described above, the EGR chamber is cooled by the intake air flowing through the intake-air branch pipes and the EGR gas in the EGR chamber is cooled, so that condensed water is easily generated. On this account, in order to prevent the condensed water from remaining inside the EGR chamber for a long time, the intake manifold provided integrally with the EGR chamber requires a structure for discharging the condensed water in the EGR chamber.

The disclosure provides an intake manifold that can discharge condensed water in an EGR chamber effectively.

An intake manifold provided in an internal combustion engine to be mounted in a vehicle, according to a first aspect of the present disclosure, includes: a plurality of intake-air branch pipes; an EGR chamber configured such that EGR gas is introduced into the EGR chamber; and a plurality of EGR ports communicating the plurality of intake-air branch pipes to the EGR chamber. A mounting lower side of the intake manifold indicates a vertically lower side relative to the intake manifold at a time when the internal combustion engine in which the intake manifold is provided is mounted in the vehicle and the vehicle has a horizontal posture. Further, a chamber bottom face indicates a mounting-lower-side surface of an inner surface of the EGR chamber. At this time, the intake manifold is configured such that the chamber bottom face is provided with a plurality of recessed zones as follows. That is, the recessed zones are provided so as to correspond to the plurality of EGR ports, and the number of recessed zones thus provided is the same as the EGR ports. Each of the plurality of recessed zones is provided near an opening of its corresponding EGR port on an EGR-chamber side, and all planes constituting the each of the plurality of recessed zone is configured to be inclined so as to be placed on the mounting lower side toward a position closer to the opening of the corresponding EGR port on the EGR-chamber side, as compared with a position away from the opening on the EGR-chamber side.

In the intake manifold according to the above aspect, condensed water existing in the EGR chamber is easily collected in a part at a bottom most point in the recessed zone. Since the part at the bottom most point is placed near the opening of the EGR port on the EGR-chamber side, the condensed water thus collected in the part at the bottom most point is easily discharged by EGR gas flowing from the EGR chamber to the intake-air branch pipe through the EGR port. Accordingly, with the above intake manifold, it is possible to effectively discharge the condensed water in the EGR chamber.

Here, if some of the port openings of the EGR ports are provided in respective parts other than the parts at the bottom most points in their corresponding recessed zones, the condensed water can be hardly discharged from those EGR ports. Accordingly, if all the plurality of EGR ports has port openings in parts at respective bottom most points in the plurality of recessed zones, it is possible to restrain a deviation between discharge amounts of the condensed water of the intake-air branch pipes. Further, the chamber bottom face may be entirely constituted by the plurality of recessed zones.

Note that, in the first aspect, the recessed zone in the intake manifold may be configured as a recess with a triangular pyramid shape having one vertex in a part of the recessed zone, the part being closer to the opening of its corresponding EGR port on the EGR-chamber side. Further, in the first aspect, an EGR introduction passage may be provided such that the EGR introduction passage is inclined so as to be placed on the mounting lower side toward a position closer to the EGR chamber, as compared with a position away from an opening on an EGR-chamber side, the EGR introduction passage being configured to introduce EGR gas into the EGR chamber. Even in the EGR introduction passage provided in the intake manifold so as to introduce the EGR gas into the EGR chamber, the condensed water may retain and generate deposits. However, with EGR introduction passage configured as described above, the condensed water in the EGR introduction passage easily fails into the EGR chamber along the inclination, so that the condensed water can hardly retain in the middle of the EGR introduction passage.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
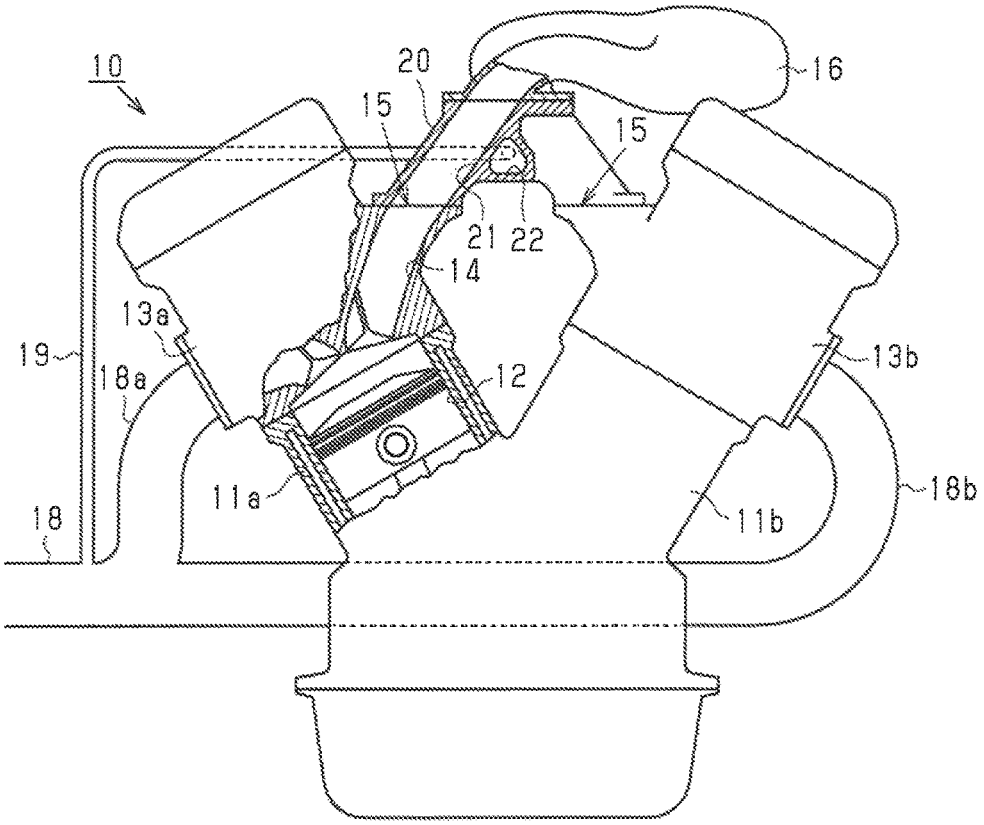
FIG. 1 is a schematic view illustrating a mounting state to an engine in terms of one embodiment of an intake manifold.

One embodiment of an intake manifold is described below in detail with reference to FIGS. 1 to 8. Note that the intake manifold of the present embodiment is provided in an internal combustion engine for a vehicle. As illustrated in FIG. 1, an intake manifold 20 of the present embodiment is provided in a V-cylinder internal combustion engine 10 in which cylinders 12 are arranged in a divided manner into two cylinder banks, i.e., a first bank 11*a* and a second bank 11*b*. Respective cylinder heads 13*a*, 13*b* are attached to respective top faces of the first bank 11*a* and the second bank 11*b* in the internal combustion engine 10. The cylinder head 13*a*, 13*b* is provided with intake ports 14 for respective cylinders 12. Note that the internal combustion engine 10 includes six cylinders 12 in total, and the first bank 11*a* and the second bank 11*b* are each provided with three cylinders 12.

Respective exhaust pipes 18*a*, 18*b* through which exhaust gas generated by combustion in the cylinders 12 flows are connected to the cylinder heads 13*a*, 13*b*. The exhaust pipes 18*a*, 18*b* are joined to each other into one exhaust pipe 18, and an EGR pipe 19 for partially recirculating the exhaust gas as EGR gas into intake air is taken out from the exhaust pipe 18 behind their joined part.

In such an internal combustion engine 10, the intake manifold 20 is provided in such a state that its lower-side part in the figure is fastened to intake-port opening surfaces 15 of both cylinder heads 13*a*, 13*b*, and a surge tank unit 16 is connected to its upper-side part in the figure. Note that, the intake manifold 20 is provided with intake-air branch pipes 21 for respective cylinders so as to send intake air to respective intake ports 14 of the cylinders 12 from the surge tank unit 16. Further, the EGR pipe 19 is connected to the intake manifold 20, and an EGR chamber 22 into which EGR gas is introduced from the EGR pipe 19 is provided inside the intake manifold 20. Note that the intake manifold is often made of resin, but the intake manifold 20, of the present embodiment, provided integrally with the EGR chamber 22 is made of aluminum alloy so as to be able to tolerate a high temperature of the EGR gas.

Figure 2:
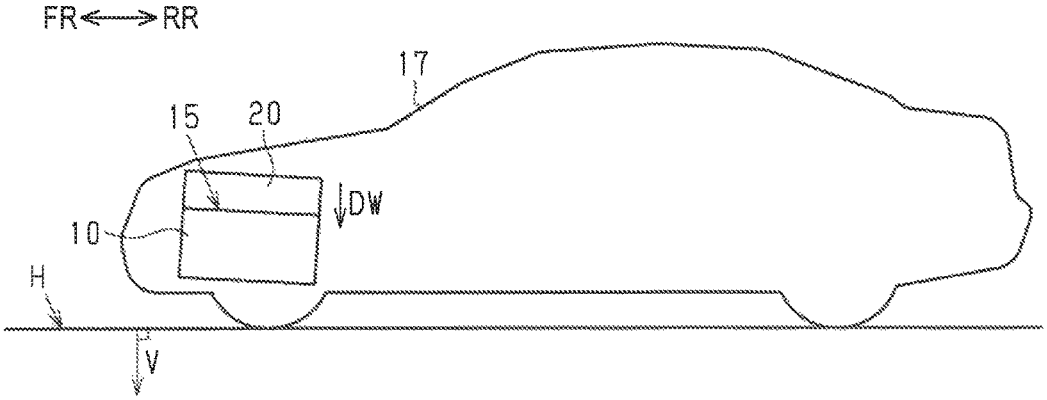
FIG. 2 is a schematic view illustrating a mounting state of the engine to a vehicle, the engine being provided with the intake manifold.

FIG. 2 illustrates a mounting posture, in a vehicle 17, of the internal combustion engine 10 in which the intake manifold 20 is provided. As illustrated in the figure, the internal combustion engine 10 is mounted in the vehicle 17 with a posture in which its vehicle rear side is slightly lowered. Here, a posture of the vehicle 17 at the time when the vehicle 17 is positioned on a horizontal plane H is assumed a horizontal posture. In the following description, when the internal combustion engine 10 in which the intake manifold 20 is provided is mounted in the vehicle 17 and the vehicle 17 has a horizontal posture, a direction (a direction indicated by an arrow V in the figure) toward a vertically lower side relative to the intake manifold 20 is assumed a mounting lower side of the intake manifold 20, and in the figures, a direction toward the mounting lower side is indicated by an arrow DW. Further, in the intake manifold 20 at this time, a direction toward a vehicle front side is assumed a mounting front side and is indicated by an arrow FR in the figures. A direction toward a vehicle rear side is assumed a mounting rear side and is indicated by an arrow RR in the figures. Further, in the intake manifold 20 at this time, a left side and a right side of the intake manifold 20 when viewed from a vehicle front-face side are assumed a mounting left side and a mounting right side, respectively, and are indicated by an arrow LH and an arrow RH, respectively, in the figures.

Figure 3:
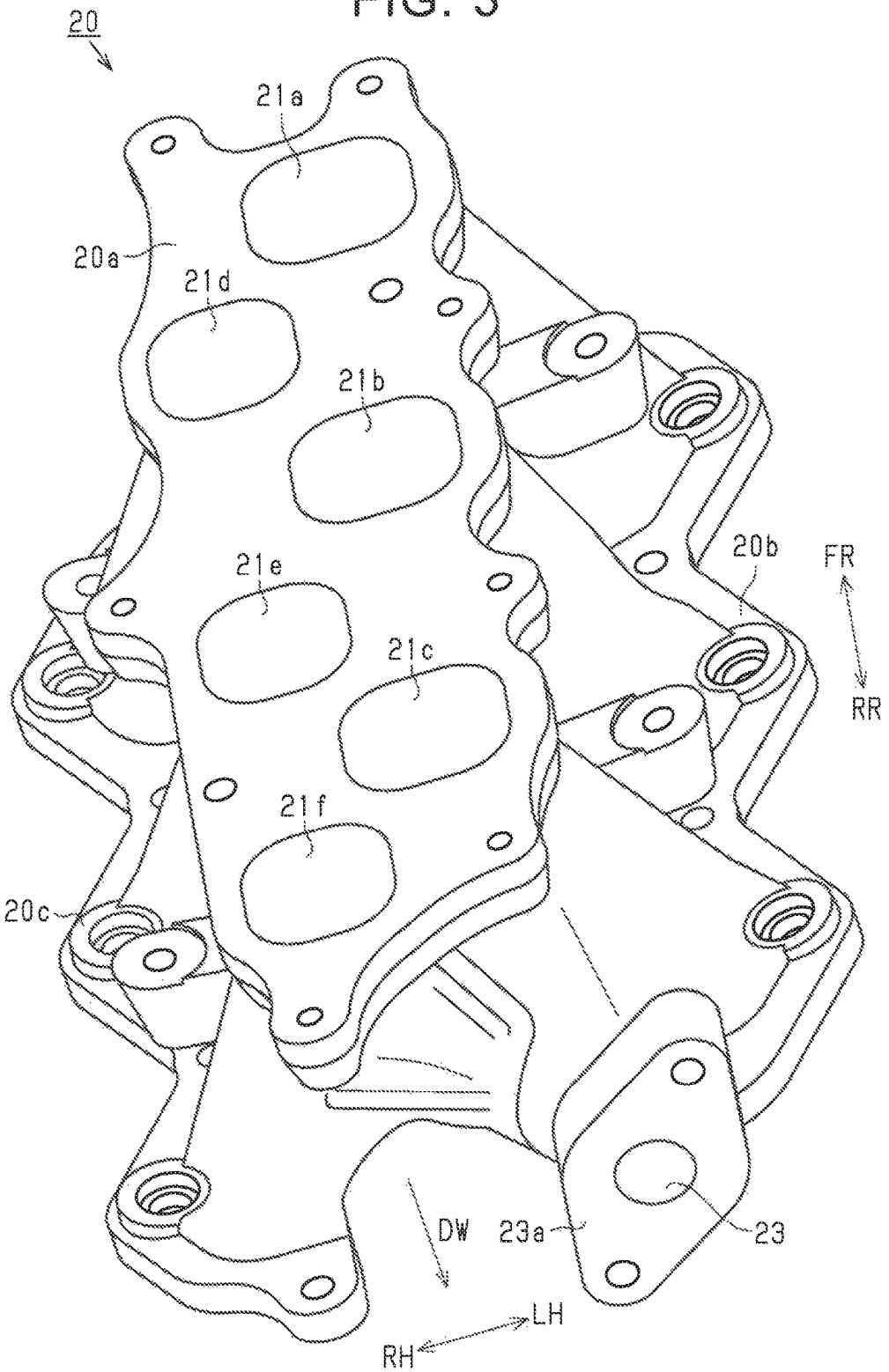
FIG. 3 is a perspective view of the intake manifold.
Figure 4:
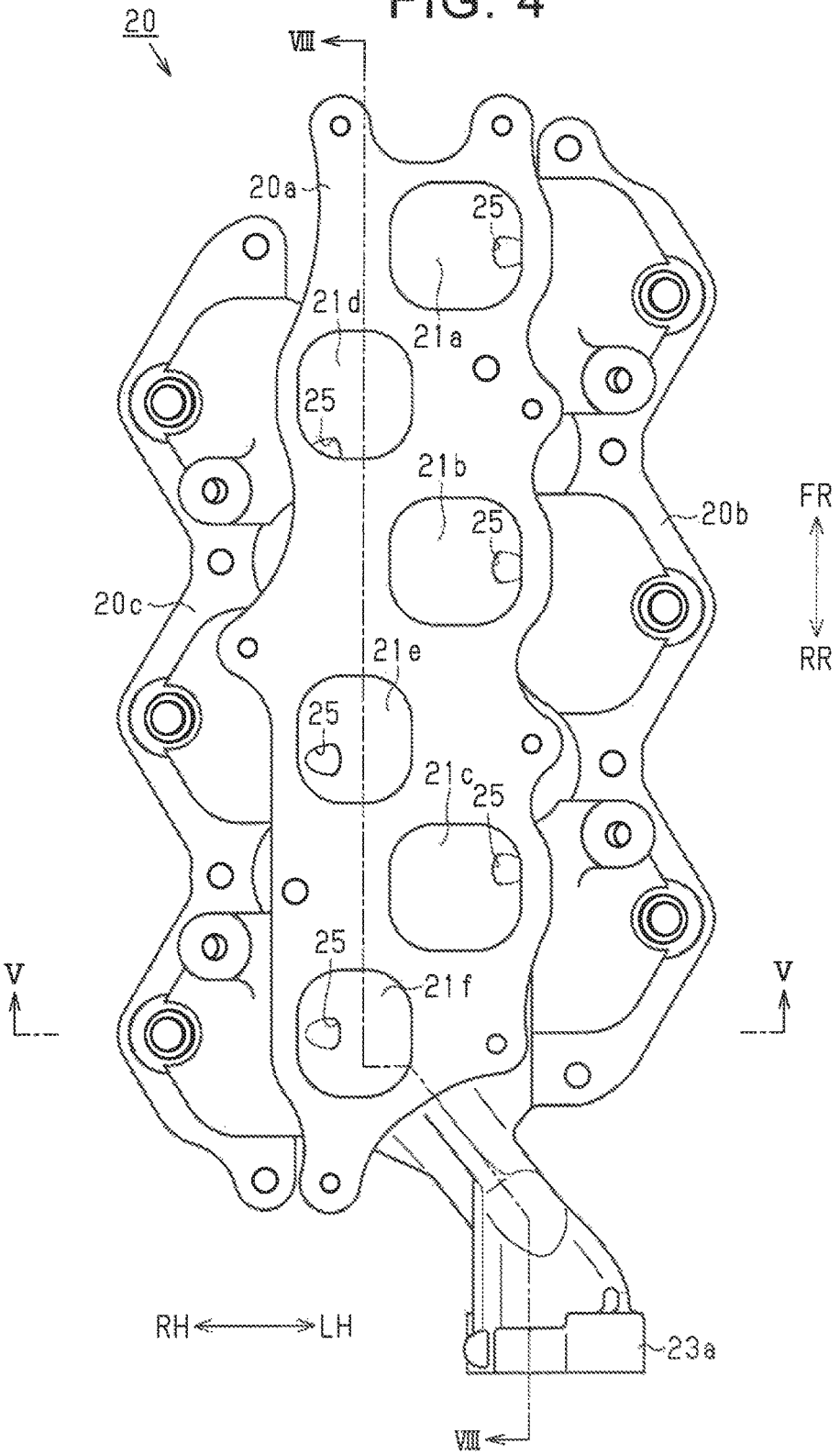
FIG. 4 is a plan view of the intake manifold.

FIG. 3 illustrates a perspective structure of the intake manifold 20, and FIG. 4 illustrates a planar structure of the intake manifold 20. As illustrated in these figures, the intake manifold 20 is provided with an intake air inflow flange 20*a*, and a first-bank intake air outflow flange 20*b* and a second-bank intake air outflow flange 20*c* each provided on the mounting lower side relative to the intake air inflow flange 20*a*. The intake air inflow flange 20*a* is a flange serving as a coupling portion of the intake manifold 20 with respect to the surge tank unit 16 (FIG. 1). Further, the first-bank intake air outflow flange 20*b* is a flange serving as a coupling portion of the intake manifold 20 with respect to the intake-port opening surface 15 of the cylinder head 13*a* on a first-bank side. Furthermore, the second-bank intake air outflow flange 20*c* is a flange serving as a coupling portion of the intake manifold 20 with respect to the intake-port opening surface 15 of the cylinder head 13*b* on a second-bank side.

In the intake air inflow flange 20*a*, six intake-air branch pipes 21 of the intake manifold 20 are opened. In the following description, those six intake-air branch pipes 21 are distinguished from each other such that alphabetical characters "a" to "f" are assigned to respective ends of their reference signs. Incidentally, the intake-air branch pipes 21*a*, 21*b*, 21*c* are intake-air branch pipes provided on the first-bank side so as to send the intake air to respective cylinders 12 of the first bank 11*a*, and the intake-air branch pipes 21*d*, 21*e*, 21*f* are intake-air branch pipes provided on the second-bank side so as to send the intake air to respective cylinders 12 of the second bank 11*b*.

The intake-air branch pipes 21*a* to 21*f* are extended from the intake air inflow flange 20*a* toward the mounting lower side. Note that an interval between the intake-air branch pipes 21*a* to 21*c* on the first-bank side and the intake-air branch pipes 21*d* to 21*f* on the second-bank side is expanded toward the mounting lower side. Mounting-lower-side ends of three intake-air branch pipes 21*a* to 21*c* on the first-bank side are connected to the first-bank intake air outflow flange 20*b*, and mounting-lower-side ends of three intake-air branch pipes 21*d* to 21*f* on the second-bank side are connected to the second-bank intake air outflow flange 20*c*. Note that, in the following description, respective mounting-lower-side surfaces of the first-bank intake air outflow flange 20*b* and the second-bank intake air outflow flange 20*c*, the mounting-lower-side surfaces abutting with respective intake-port opening surfaces 15 on the first-bank side and on the second-bank side at the time of mounting to the internal combustion engine 10, are described as a bottom face of the intake manifold 20.

Further, an EGR introduction side flange 23*a* is provided on the mounting rear side of the intake manifold 20. The EGR introduction side flange 23*a* is a flange serving as a coupling portion of the intake manifold 20 with respect to the EGR pipe 19 (FIG. 1).

Figure 5:
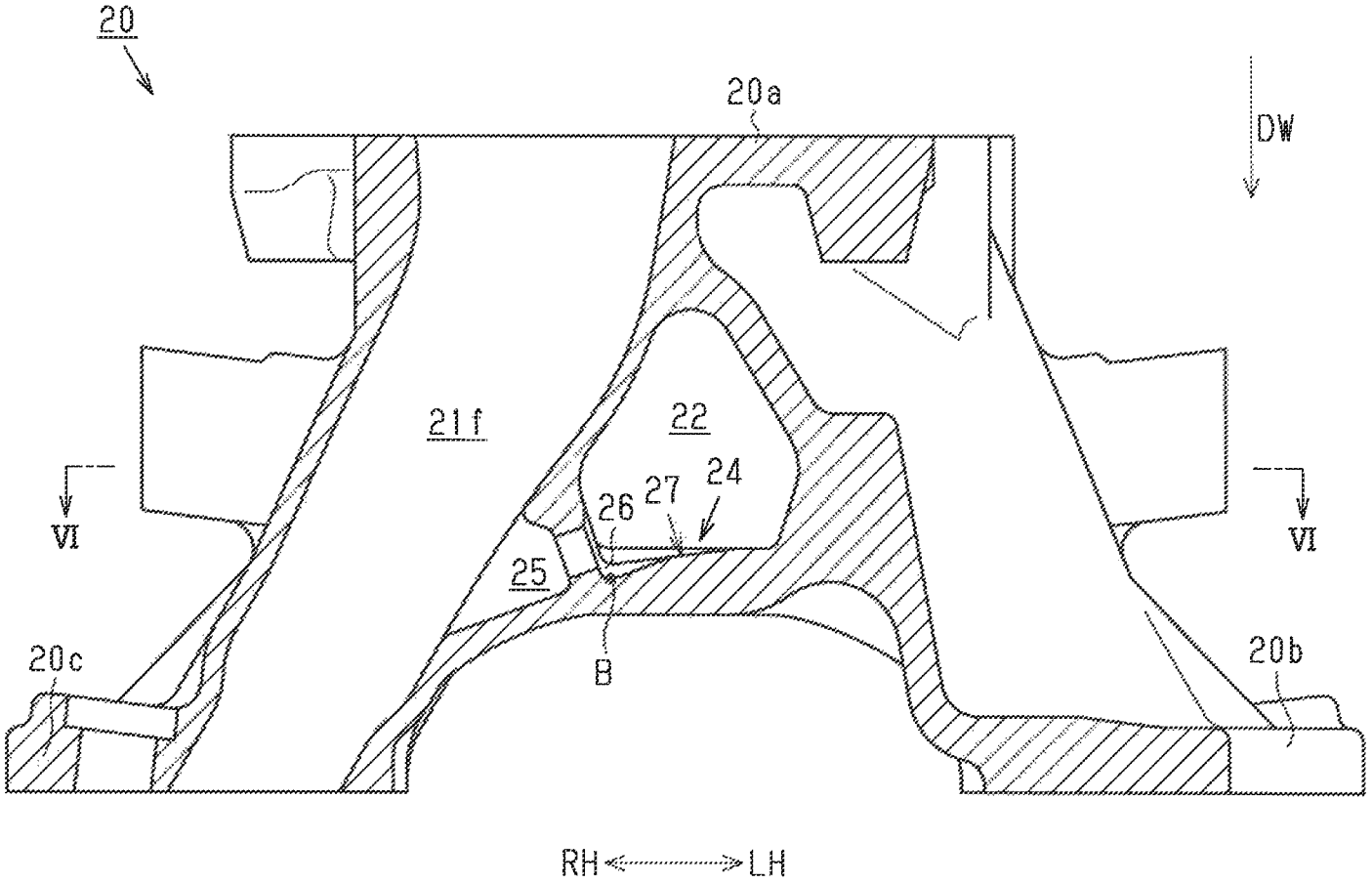
FIG. 5 is a sectional view of the intake manifold in a section taken along a line V-V in FIG. 4.

FIG. 5 illustrates a sectional structure of the intake manifold 20 in a section taken along a line V-V in FIG. 4. As illustrated in the figure, in the intake manifold 20, the EGR chamber 22 is provided in a part between the intake-air branch pipes 21*a* to 21*c* on the first-bank side and the intake-air branch pipes 21*d* to 21*f* on the second-bank side. Further, the intake manifold 20 is provided with EGR ports 25 for respective intake-air branch pipes 21*a* to 21*f*, the EGR ports 25 being communicating holes for sending EGR gas from the EGR chamber 22 thereto. Note that, in the section of the figure, only the EGR port 25 that communicates one (21*f*) of the intake-air branch pipes 21*a* to 21*f* with the EGR chamber 22 is illustrated, but similar EGR ports 25 are also provided for the other intake-air branch pipes, respectively. In the following description, a part, of the EGR chamber 22, where an opening of the EGR port 25 is provided is described as a port opening 26.

Figure 6:
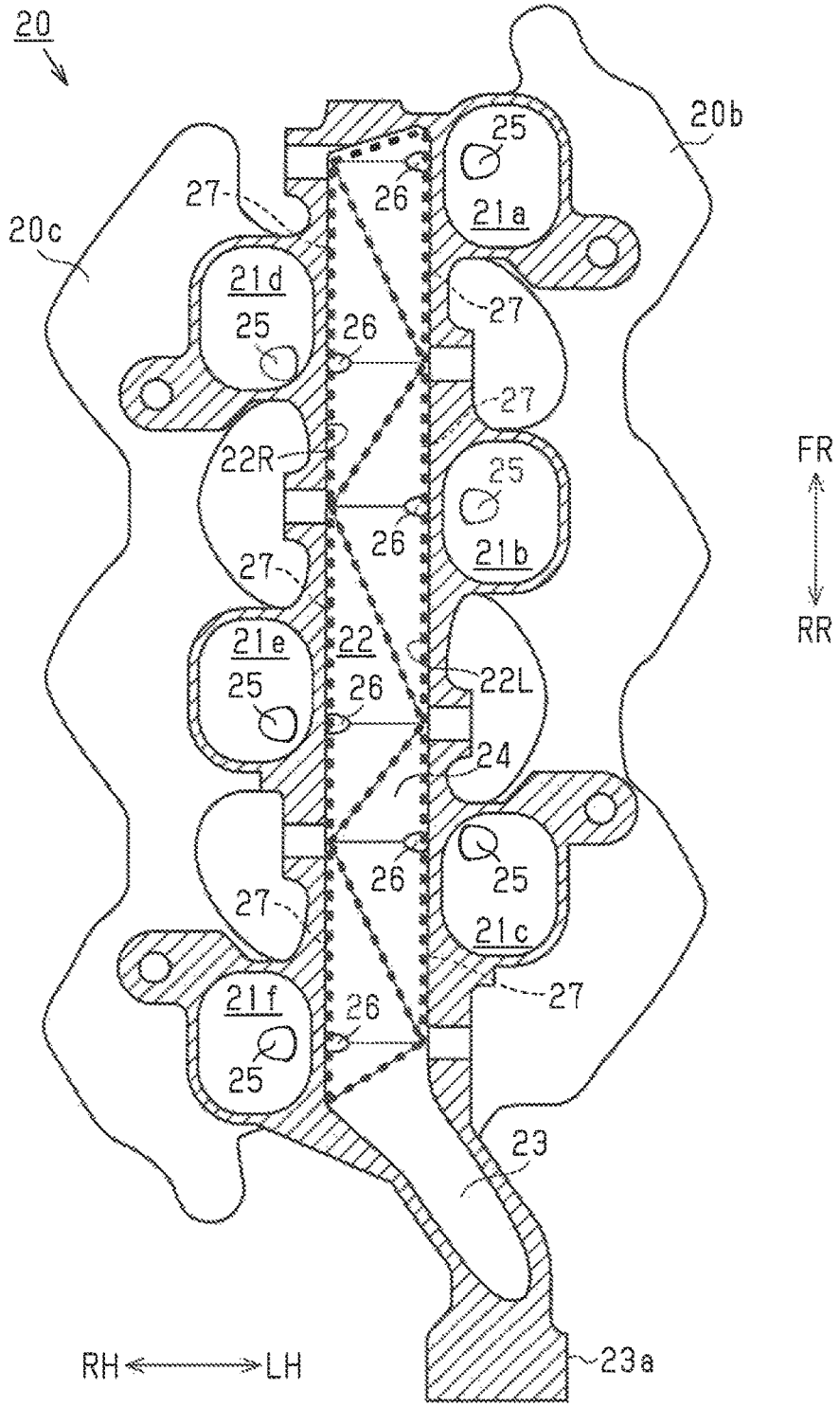
FIG. 6 is a sectional view of the intake manifold in a section taken along a line VI-VI in FIG. 5.

FIG. 6 illustrates a sectional structure of the intake manifold 20 cut on a section taken along a line VI-VI in FIG. 5. Note that, in the following description, a mounting-lower-side surface of an inner surface of the EGR chamber 22 is referred to as a chamber bottom face 24. Further, a mounting-left-side side face of the inner surface of the EGR chamber 22 is referred to as a chamber left side face 22L, and a mounting-right-side side face of the inner surface of the EGR chamber 22 is referred to as a chamber right side face 22R.

As illustrated in the figure, the EGR chamber 22 is formed in a tube shape extending in a mounting front-rear direction inside the intake manifold 20. In the EGR chamber 22, the port openings 26 of the EGR ports 25 communicating with the intake-air branch pipe 21*a* to 21*c* on the first-bank side are provided in their corresponding parts, of the chamber bottom face 24, which make contact with the chamber left side face 22L. Further, the port openings 26 of the EGR ports 25 communicating with the intake-air branch pipe 21*d* to 21*f* on the second-bank side are provided in their corresponding parts, of the chamber bottom face 24, which make contact with the chamber right side face 22R. Further, an EGR introduction passage 23 extended from the EGR chamber 22 toward the mounting rear side so as to be opened in the EGR introduction side flange 23*a* is formed inside the intake manifold 20.

In the meantime, the chamber bottom face 24 is formed as a surface having a plurality of recesses. Such a chamber bottom face 24 is constituted by a plurality of recessed zones 27. The number of recessed zones 27 provided in the chamber bottom face 24 of the intake manifold 20 is the same (herein, six) as the number of EGR ports 25. A shape of the recessed zone 27 when the chamber bottom face 24 is viewed from the mounting upper side is a triangle in which one side makes contacts with either one of the chamber left side face 22L and the chamber right side face 22R and an opposite vertex of the one side makes contact with the other one of them. On the chamber bottom face 24, the recessed zones 27 in which the one side makes contact with the chamber left side face 22L and the recessed zones 27 in which the one side makes contact with the chamber right side face 22R are arranged alternately. Further, the recessed zone 27 is placed so as to make contact with its adjacent recessed zone 27, and the chamber bottom face 24 is entirely constituted by six recessed zones 27. The port opening 26 of each of the EGR ports 25 is provided in a part of its corresponding recessed zone 27, the part making contact with either one of the chamber left side face 22L and the chamber right side face 22R.

Figure 7:
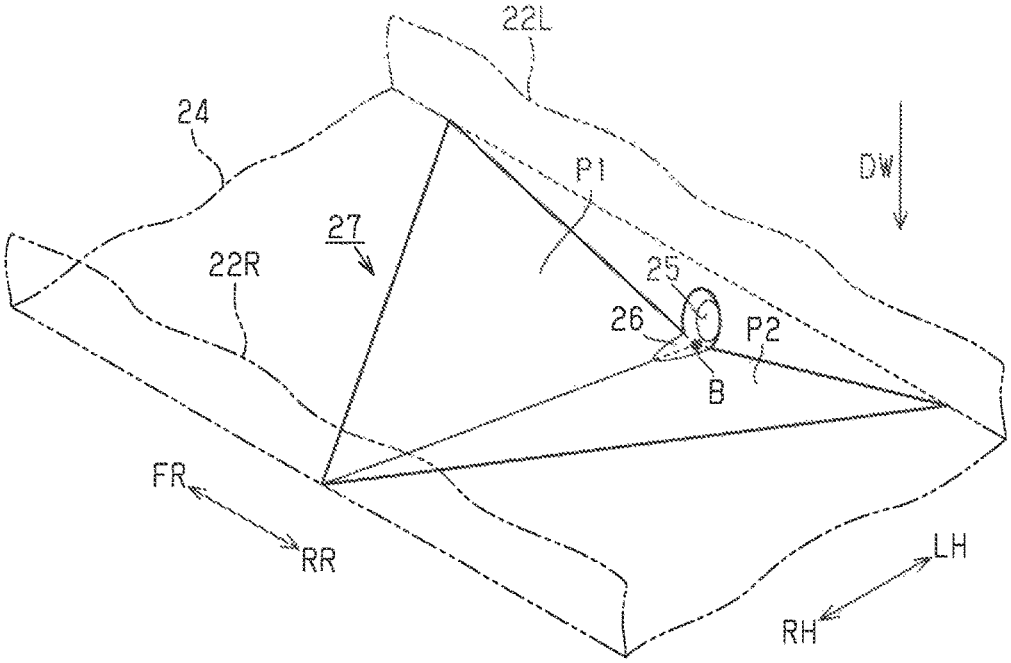
FIG. 7 is a schematic view illustrating a shape of a recessed zone provided on a chamber bottom face of the intake manifold.

The recessed zone 27 illustrated in FIG. 7 is provided with the port opening 26 of the EGR port 25 communicating with one of the intake-air branch pipe 21*a* to 21*c* on the first-bank side. The configuration of the recessed zones 27 provided with the port openings 26 of the EGR ports 25 communicating with the intake-air branch pipe 21*d* to 21*f* on the second-bank side is symmetric in the mounting right-left direction to FIG. 7.

As illustrated in the figure, the recessed zone 27 is constituted by two planes P1, P2 each having a triangular shape. These planes P1, P2 are places inclined so as to be placed on the mounting lower side at a position closer to a part provided with the port opening 26. Such a recessed zone 27 is formed as a recess having a triangular pyramid shape having one vertex at the part provided with the port opening 26. Note that, in the following description, a point serving as a vertex at the part provided with the port opening 26, among four vertexes in the triangular pyramid shape, is referred to as a bottom most point B.

Such a recessed zone 27 is inclined so that the entire recessed zone 27 is placed on the mounting lower side as it approaches the bottom most point B, which is one point in this zone. That is, in the intake manifold 20, the port opening 26 of each of the EGR ports 25 is provided in the part at the bottom most point B in its corresponding recessed zone 27.

Figure 8:
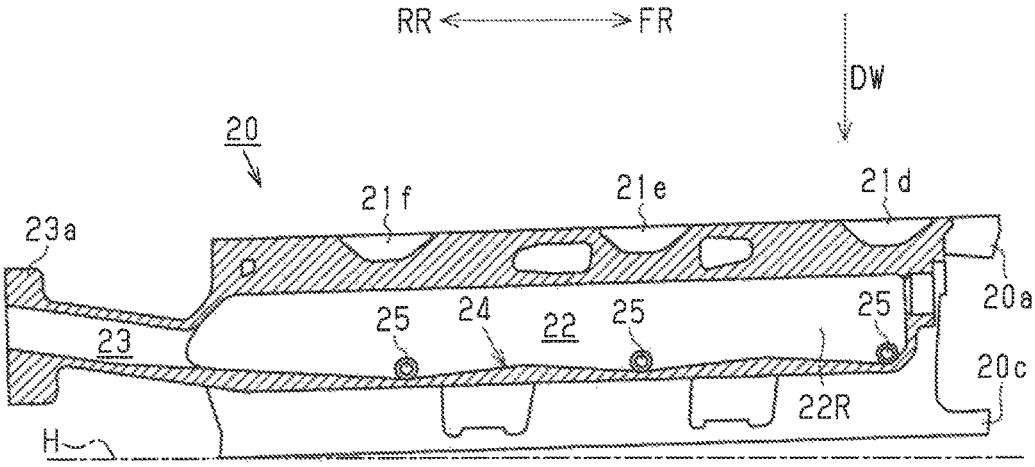
FIG. 8 is a sectional view of the intake manifold in a section taken along a line VIII-VIII in FIG. 4.

FIG. 8 illustrates a sectional structure of the intake manifold 20 in a section taken along a line VIII-VIII in FIG. 4. As illustrated in the figure, in the intake manifold 20 of the present embodiment, the EGR introduction passage 23 is formed as a passage that is inclined to be placed on the mounting lower side as it approaches the EGR chamber 22.

Next will be described operations and effects of the intake manifold 20 of the present embodiment configured as described above. During an operation of the internal combustion engine 10 in which the intake manifold 20 of the present embodiment is provided, EGR gas is introduced into the EGR chamber 22 via the EGR introduction passage 23 from the EGR pipe 19 connected to the EGR introduction side flange 23*a* in the intake manifold 20. The EGR gas introduced into the EGR chamber is distributed to the intake air flowing through the intake-air branch pipes 21*a* to 21*f* via the EGR ports 25.

In the meantime, when the EGR gas is cooled to a temperature of a condensation point of water or lower, water vapor in the EGR gas condenses so that condensed water is generated. Meanwhile, in the intake manifold 20 of the present embodiment provided integrally with the EGR chamber 22, the EGR introduction passage 23, and the intake-air branch pipes 21*a* to 21*f*, the EGR chamber 22 and the EGR introduction passage 23 are cooled by the intake air flowing through the intake-air branch pipes 21*a* to 21*f*. Because of this, in the intake manifold 20, the EGR gas is easily cooled in the EGR chamber 22 and the EGR introduction passage 23 thus cooled off, so that condensed water is easily generated. Note that the intake manifold 20 of the present embodiment is made of aluminum alloy having a thermal conductivity higher than resin, and the EGR gas is more easily cooled than an intake manifold made of resin.

When such condensed water remains in the EGR chamber 22 or the EGR introduction passage 23 for a long time, HC and soot in the EGR gas are dissolved in the condensed water and accumulated, thereby resulting in that they remain in the EGR chamber 22 or the EGR introduction passage 23 as deposits after evaporation of the condensed water. The deposits may enter the EGR port 25 by a flow of the EGR gas and clog the EGR port 25.

In this regard, in the intake manifold 20 of the present embodiment, when the vehicle 17 has a horizontal posture or a nearly horizontal posture, a part, in the recessed zone 27, at the bottom most point B at which the port opening 26 is provided serves as a part on a vertically lowermost side in the recessed zone 27. On that account, the condensed water attached to the chamber bottom face 24 falls along an inclined surface of the recessed zone 27, so as to be easily collected at the port opening 26. Further, in a part of the EGR chamber around the port opening 26, the EGR gas flows toward the EGR port 25, so the condensed water is also collected in the port opening 26 by the flow of the EGR gas. The condensed water thus collected near the port opening 26 is easily discharged from the EGR chamber 22 by the EGR gas directed toward the intake-air branch pipes 21*a* to 21*f* through the EGR ports 25. As such, in the intake manifold 20 of the present embodiment, the recessed zone 27 provided in the chamber bottom face 24 functions as a discharge structure that promotes the discharge of the condensed water from the EGR chamber 22.

Incidentally, the condensed water discharged to the intake-air branch pipes 21*a* to 21*f* is sent to the cylinders 12 together with the intake air, but the condensed water sent to the cylinders 12 affects combustion in the cylinders 12. Because of this, if there is a large deviation between amounts of the condensed water discharged from the EGR chamber 22 to the intake-air branch pipes 21*a* to 21*f*, a combustion state might vary between the cylinders 12. Here, if the port openings 26 of some of the EGR ports 25 are provided in respective parts other than the parts at the bottom most points B in their corresponding recessed zones 27, the condensed water can be hardly discharged from those EGR ports 25. In this regard, in the present embodiment, the port opening 26 of the EGR port 25 provided in the intake manifold 20 is provided in the part at the bottom most point B in the recessed zone 27, and the deviation between the amounts of the condensed water discharged to the intake-air branch pipes 21*a* to 21*f*, eventually, the variation between the combustion states of the cylinders 12 are restrained.

Further, in the intake manifold 20 of the present embodiment, the EGR introduction passage 23 configured to introduce the EGR gas into the EGR chamber 22 is provided as a passage that is inclined to be placed on the mounting lower side as it approaches the EGR chamber 22. In such an EGR introduction passage 23, when the vehicle 17 has a horizontal posture or a nearly horizontal posture, the condensed water easily toward the EGR chamber 22 along the inclination of the EGR introduction passage 23.

As such, in the intake manifold 20 of the present embodiment, it is possible to effectively discharge the condensed water from the EGR introduction passage 23 or the EGR chamber 22. As a result, it is possible to restrain retention of the condensed water in the EGR chamber 22 or the EGR introduction passage 23, eventually, the generation of deposits due to the retention.

Other Embodiments

In the above embodiment, the recessed zone 27 is formed as a recess having a triangular pyramid shape with the bottom most point B as one vertex. The recess shape of the recessed zone 27 is not limited to this, but may be changed appropriately.

Figure 9:
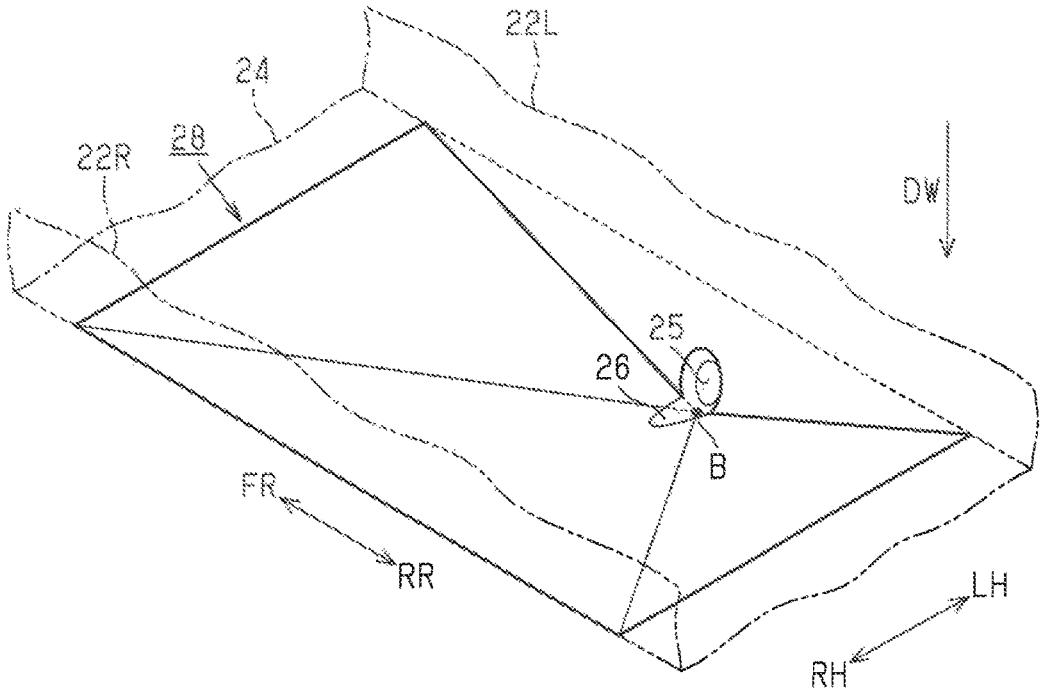
FIG. 9 is a schematic view illustrating a shape of a recessed zone in a modification of the intake manifold.

FIG. 9 illustrates one example of a recessed zone 28 formed as a recess having a quadrangular pyramid shape. The recessed zone 28 illustrated in the figure has a rectangular shape when viewed from the mounting upper side, and a port opening 26 is provided in a part, of the recessed zone 28, which makes contact with a chamber left side face 22L. The recessed zone 28 is also configured such that flat planes constituting the recessed zone 28 are planes inclined so as to be placed on the mounting lower side as they approach a bottom most point B positioned at a part provided with the port opening 26, and functions as a discharge structure that collects condensed water to the port opening 26 and facilitates its discharge.

Incidentally, it is also possible to employ a shape other than a pyramid shape as the recess shape of the recessed zone, and a recess shape that is partially or wholly curved may be employed, for example. In any case, if the planes constituting the recessed zone are inclined so as to be placed on the mounting lower side as they approach the port opening 26, the condensed water is easily collected at the port opening 26, so that the condensed water is easily discharged.

Further, in the intake manifold 20 of the present embodiment, the port opening 26 is provided in a part, of the recessed zone, which makes contact with the chamber left side face 22L or the chamber right side face 22R. The port opening 26 may be provided at a position different from the above in the recessed zone.

Figure 10:
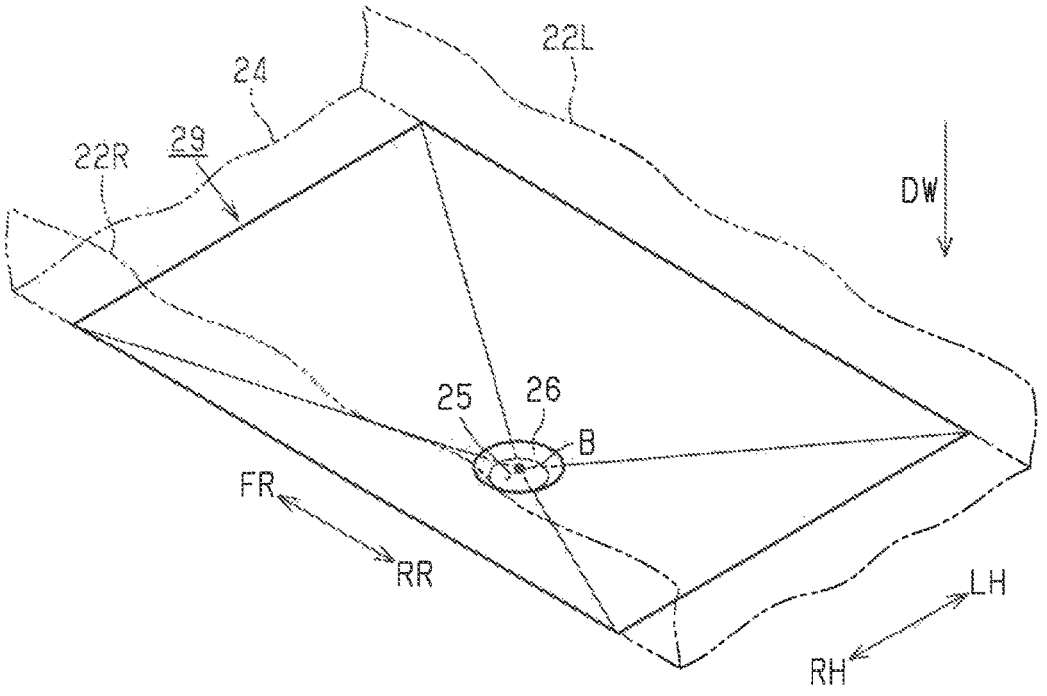
FIG. 10 is a schematic view illustrating a shape of a recessed zone in another modification of the intake manifold.

In a recessed zone 29 illustrated in FIG. 10, a port opening 26 is provided in a central part of the recessed zone 29. Such a recessed zone 29 is formed as a recess having a quadrangular pyramid shape having a vertex (a bottom most point B) in a part provided with such a port opening 26. Such a recessed zone 29 is also generally inclined so as to be placed on the mounting lower side as it approaches the bottom most point B at which the port opening 26 is positioned, so that the condensed water is easily collected at the port opening 26. Accordingly, it is possible to effectively discharge the condensed water in the EGR chamber 22.

Further, the above embodiment also can be performed with the following modification. In the intake manifold 20 of the present embodiment, the EGR introduction passage 23 is provided so as to serve as a passage that is inclined to be placed on the mounting lower side as it approaches the EGR chamber 22, thereby restraining the condensed water from remaining in the EGR introduction passage 23. In fact, if the amount of condensed water generated in the EGR introduction passage 23 is very small, the remaining of the condensed water in the EGR introduction passage 23 does not become a problem. On that account, in such a case, if it is not necessary to consider the remaining of the condensed water in the EGR introduction passage 23, the EGR introduction passage 23 may have a shape other than the above.

In the intake manifold 20 of the above embodiment, the recessed zones on the chamber bottom face 24 are provided such that the recessed zones adjacent to each other make contact with each other. However, a given interval may be provided between the recessed zones. That is, a part of the chamber bottom face 24 may have a part that is not inclined downward toward any of the port openings 26.

The above embodiment describes a case of the intake manifold 20 to be provided in the V-cylinder internal combustion engine 10, but the discharge structure of the condensed water by the recessed zone can be also applied to an intake manifold to be provided in other cylinder type internal combustion engine.

What is claimed is:

1. An intake manifold provided in an internal combustion engine to be mounted in a vehicle, the intake manifold comprising:

a plurality of intake air branch pipes;

an EGR chamber configured such that EGR gas is introduced into the EGR chamber;

a plurality of EGR ports communicating the plurality of intake-air branch pipes with the EGR chamber;

a chamber bottom face including a plurality of recessed zones corresponding to the plurality of EGR ports, each of the recessed zones including a plurality of planes with a triangular shape, wherein the number of recessed zones is the same as the number of EGR ports, each of the plurality of recessed zones is provided adjacent an opening of its corresponding EGR port being positioned in a side of the EGR chamber, and each plane of the plurality of recessed zones is inclined toward the corresponding EGR port with a vertex of the triangular shape positioned at the opening of the corresponding EGR port.

2. The intake manifold according to claim 1, wherein the chamber bottom face is entirely constituted by the plurality of recessed zones.

3. The intake manifold according to claim 1, wherein:

the recessed zone is configured as a recess having a triangular pyramid shape having the vertex of each plane of the triangular pyramid shape of the corresponding recessed zone intersecting each other at the opening of the corresponding EGR port.

4. The intake manifold according to claim 1, further comprising:

an EGR introduction passage inclined toward the chamber bottom face with a passage opening positioned in a second side of the EGR chamber adjacent the chamber bottom face, the EGR introduction passage being configured to introduce EGR gas into the EGR chamber.

5. The intake manifold according to claim 1, wherein the recessed zone is configured as a recess having a quadrangular pyramid shape with its bottom most point being where the vertex of each plane of the corresponding recessed zone intersect each other.

6. The intake manifold according to claim 1, wherein the plurality of recessed zones is configured such that a given interval is provided between the recessed zones adjacent to each other.

7. The intake manifold according to claim 1, wherein the intake manifold is configured for a V-cylinder internal combustion engine.

8. The intake manifold according to claim 1, wherein the opening of each EGR port extends into the chamber bottom face and includes a point lower than the corresponding EGR port at the opening, the point being adjacent the intersection of each vertex of the corresponding recessed zone.

* * * * *